US012467713B2

(12) United States Patent
Fisher et al.

(10) Patent No.: US 12,467,713 B2
(45) Date of Patent: Nov. 11, 2025

(54) ARCHERY BOW POD

(71) Applicant: Arizona Archery Enterprises, Inc. (AAE), Prescott Valley, AZ (US)

(72) Inventors: Nicholas Morgan Fisher, Prescott Valley, AZ (US); Greg Poole, Dewey, AZ (US)

(73) Assignee: Arizona Archery Enterprises, Inc. (AAE), Prescott Valley, AZ (US)

( * ) Notice: Subject to any disclaimer, the term of this patent is extended or adjusted under 35 U.S.C. 154(b) by 0 days.

(21) Appl. No.: 18/531,459

(22) Filed: Dec. 6, 2023

(65) Prior Publication Data

US 2025/0189262 A1 Jun. 12, 2025

(51) Int. Cl.
*F41A 23/10* (2006.01)
*F41B 5/14* (2006.01)

(52) U.S. Cl.
CPC ..... *F41B 5/1453* (2013.01)

(58) Field of Classification Search
CPC ..... F41B 5/1453
See application file for complete search history.

(56) References Cited

U.S. PATENT DOCUMENTS

| | | | | |
|---|---|---|---|---|
| 3,235,997 | A * | 2/1966 | Stoner | F41A 23/08 89/37.03 |
| 6,763,627 | B1 * | 7/2004 | Kaempe | F41A 23/10 89/37.04 |
| 8,161,956 | B2 | 4/2012 | Bednar | |
| D734,417 | S | 7/2015 | Wilkinson | |
| 9,255,751 | B1 * | 2/2016 | Beltz | F41A 23/10 |
| 9,400,154 | B2 | 7/2016 | McPherson | |
| 9,568,270 | B1 * | 2/2017 | LoRocco | F41B 5/1453 |
| 9,638,488 | B1 | 5/2017 | Broberg et al. | |
| 9,803,950 | B1 | 10/2017 | Khoshnood et al. | |
| 9,933,225 | B2 | 4/2018 | Yehle et al. | |
| D819,159 | S | 5/2018 | Leis et al. | |
| 9,976,693 | B1 | 5/2018 | Delikat et al. | |
| 10,408,555 | B2 * | 9/2019 | Flood, Jr. | F41A 23/10 |
| 10,760,870 | B2 | 9/2020 | Bunch | |
| 11,085,730 | B2 | 8/2021 | Carpenter | |
| 11,385,015 | B2 | 7/2022 | Coalson et al. | |
| 11,391,533 | B2 | 7/2022 | Favory | |
| D962,377 | S | 8/2022 | Summers et al. | |
| D967,918 | S | 10/2022 | Leis | |
| 2021/0270561 | A1 | 9/2021 | Ochs | |
| 2022/0049923 | A1 | 2/2022 | Popa | |
| 2022/0155038 | A1 | 5/2022 | Leis et al. | |

* cited by examiner

*Primary Examiner* — Amy J. Sterling

(57) ABSTRACT

An archery bow pod system is disclosed and may include a first leg, a second leg configured to engage the first leg, a link configured to engage the first leg, and a clamp configured to rotate axially around a top of the first leg and configured to engage the link and an archery bow, wherein the archery bow is held in an upright position when engaged with the clamp.

19 Claims, 8 Drawing Sheets

ARCHERY BOW POD

FIELD

The technology described herein relates to a novel archery bow pod/stand. The archery bow pod disclosed herein is a valuable tool for keeping an archery bow upright, and protecting the bow limbs and compound bow cams from ground debris.

BACKGROUND

Conventional archery bow pods, stands, or holders, are useful for resting an archery bow in an upright position while an archer retrieves arrows from a target or wishes to keep an archery bow off the ground. Conventional systems typically attach to archery bows to assist a bow in maintaining a vertical orientation while being supported by the ground via two contact surfaces and typically rely upon another attached accessory, such as a support or other stabilizer, to provide a third contact surface. Conventional systems, however, are bulky, heavy, and difficult to attach and detach from archery bows. The present disclosure describes an innovative archery bow pod that is lightweight, simple to operate, and compatible with various types of archery bows such as compound bows, recurve bows, and longbows.

SUMMARY

Embodiments of the present disclosure are directed to an archery bow pod system that may include a first leg, a second leg configured to engage the first leg, a link configured to engage the first leg, and a clamp configured to engage the link and an archery bow, wherein the clamp may be further configured to move in a vertical plane, and wherein the archery bow may be held in an upright position when engaged with the clamp. In other examples, the clamp may be configured to rotate axially around a top of the first leg to allow angular adjustment of the first and second legs in relation to a bow limb angle to keep the archery bow pod perpendicular to the contact a surface or the ground. In some examples, the clamp may be generally "L" shaped, and the clamp may be movable in a vertical plane when engaged with the link. In other examples, the link may be generally rectangular or cuboidal shaped. In still other examples, the link may include a front face and a rear face, and the rear face may include a vertical groove. In certain examples, the vertical groove may extend from a top of the link to a bottom of the link. In some examples, the link may further include a first ridge and a second ridge parallel to each other and positioned on each side of the groove, and a tapered compression cone may be positioned in the center of the link. In another example, the compression cone may be generally tapered, cylindrical-shaped, or frustoconical-shaped, and the compression cone may extend distally from a front face of the link. In one example, the compression cone may further include an insert positioned in the center of the compression cone that may extend through the front face of the link through a rear face of the link. In yet another example, the compression cone may be configured to engage the first leg, and the clamp may be movable in a vertical plane and/or rotated axially when the link is engaged with the clamp guide. In one example, the clamp guide may be oval-shaped or rectangular-shaped.

In yet other embodiments, an archery bow pod is described herein that may include a link that may include a front face, a rear face, a compression cone extending distally from the front face, and a first insert positioned above the compression cone, and a second insert positioned below the compression cone, a pair of legs configured to engage the link, and a clamp configured to movably engage the link and an archery bow riser. The clamp may be configured to rotate axially around an upper portion of the pair of legs to secure an archery bow in a vertical position when the clamp is secured to the archery bow riser and the pair of legs are positioned on a surface. In some examples, the pair of legs may be configured to engage a tension spring, and the tension spring may maintain the pair of legs in an extended position. In one example, the pair of legs may be foldable. In another example, the pair of legs include trestle structures, and the trestle structures may be generally diamond-shaped, triangular-shaped, polygonal-shaped, or combinations thereof. In certain examples, the clamp may be generally "L" shaped, and the clamp may include a vertical post and a horizontal bar, wherein the vertical post may be configured to engage the link, and wherein the horizontal bar may be configured to engage the archery bow riser. In still other examples, the vertical post may include a clamp guide configured to engage the compression cone, and the clamp may be movable in a vertical plane when the compression cone is engaged with the clamp guide. In some examples, the horizontal bar may include a polymer or rubber coating. In another example, the archery bow may be a compound, a recurve, or a longbow.

In yet another embodiment, a system is disclosed herein that may include an archery bow and a bow pod that may be configured to engage the archery bow. In certain examples, the bow pod may include a first leg, a second leg, a clamp, and a link. In some examples, the first leg may be configured to engage the second leg, the first leg may be configured to engage the link, the link may be configured to engage the clamp, the clamp may be configured to adjust in a vertical plane, the clamp may be configured to removably engage a riser of the archery bow, and the archery bow may be held in an upright position when engaged with the clamp.

Further features and advantages of certain embodiments of the present invention will become more fully apparent in the following description of embodiments and drawings thereof, and from the claims.

BRIEF DESCRIPTION OF THE DRAWINGS

The present disclosure is illustrated by way of example and not limited in the accompanying figures in which like reference numerals indicate similar elements and in which.

Further features and advantages of certain embodiments of the present invention will become more fully apparent in the following description of embodiments and drawings thereof, and from the claims.

DETAILED DESCRIPTION

While this invention may be embodied in many different forms, there are described in detail herein specific embodiments of the invention. This description is an exemplification of the principles of the invention and is not intended to limit the invention to the particular embodiments illustrated.

Figure 1:
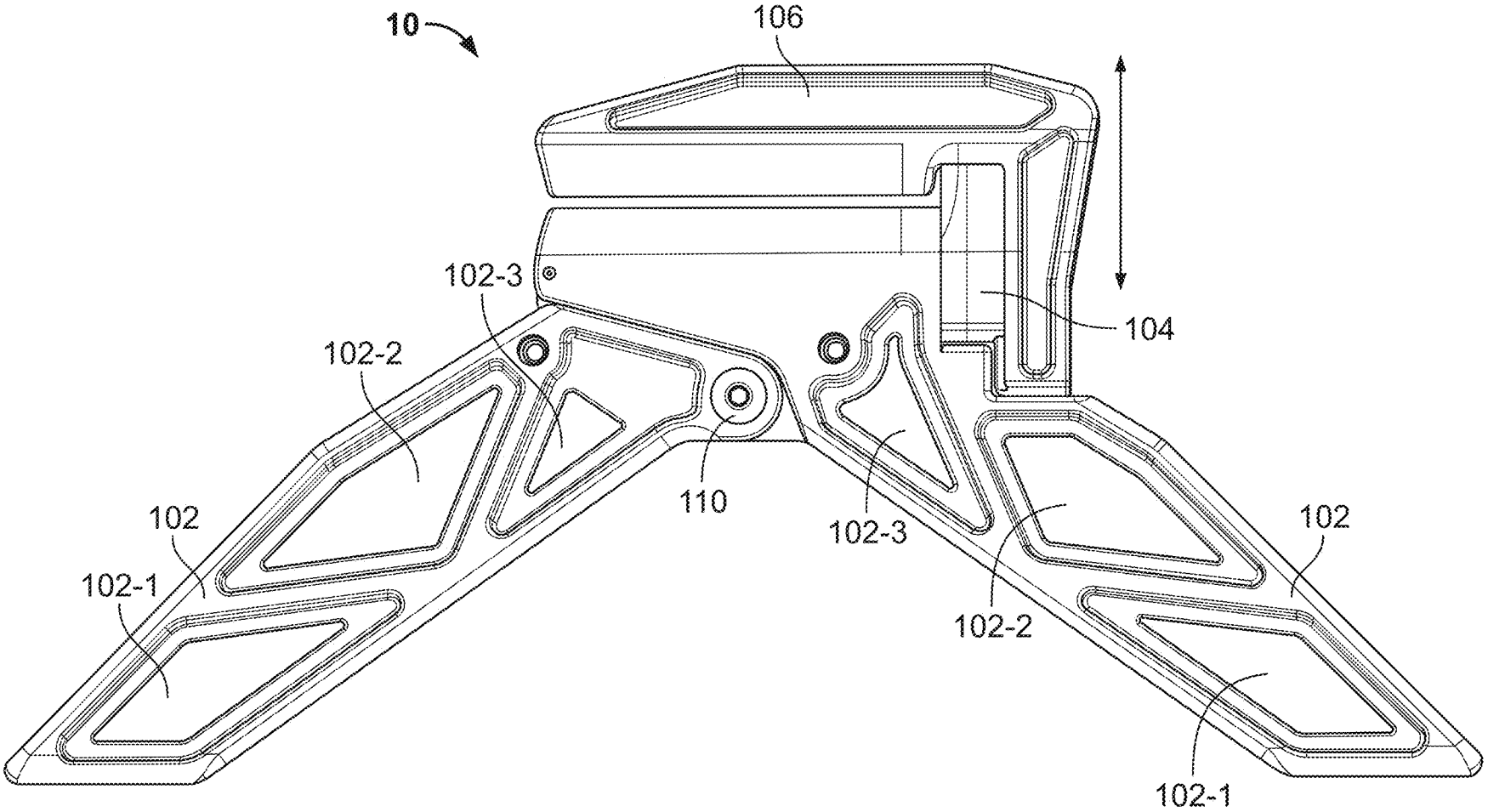
FIG. 1 depicts a front view of an example archery bow pod as described herein.
Figure 2:
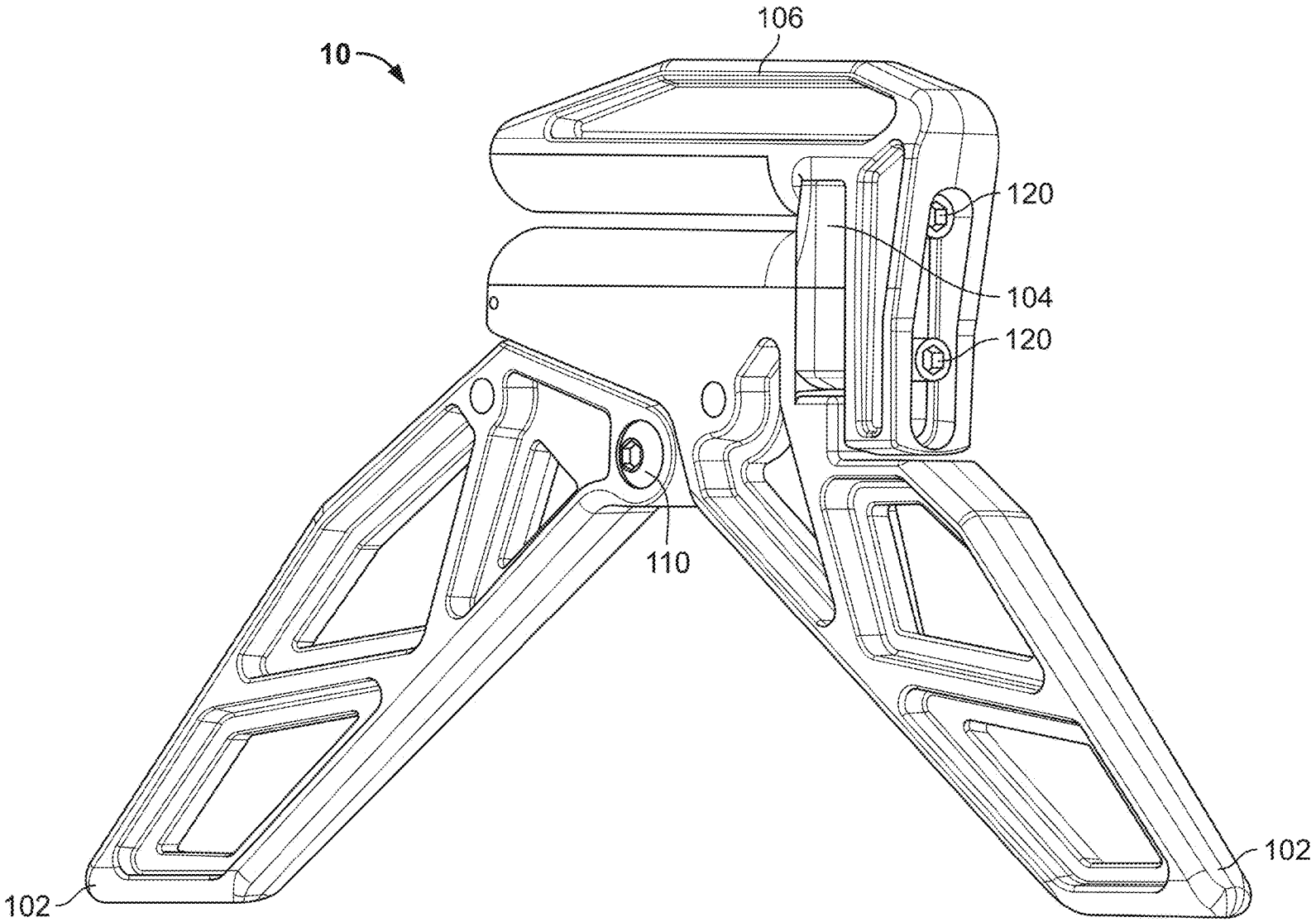
FIG. 2 depicts a front-perspective view of an example archery bow pod as described herein.

Aspects of the present disclosure are directed to an archery bow pod/holder and related systems. FIGS. 1 and 2 depict bow pod system 10. Bow pod 10 may include at least one leg 102, link 104, and clamp 106. Legs 102 may include a trestle structures 102-1, 102-2, and 102-3. Trestle structures 102-1, 102-2, and 102-3 may comprise diamond-shaped, triangular-shaped, or polygonal-shaped openings. The inventor surprisingly discovered that the trestle structures drastically reduced the weight of bow pod 10 yet unexpectedly maintained tensile strength due to the particular trestle structure opening shapes. Link 104 may be configured to couple at least one leg 102 to clamp 106. Bow pod 10 may also include stainless steel button head hex drive screw 110 that may be used to secure or couple first and second legs 102 to each other. In certain examples, clamp 106 may be moved and positioned in a vertical plane as depicted by the bi-directional arrow shown in FIG. 1. As also shown in FIG. 2, clamp screws 120 may removably secure clamp 106 to link 104, stainless steel button head hex drive screw 110 may be used to secure or couple first and second legs 102 to each other.

Figure 3:
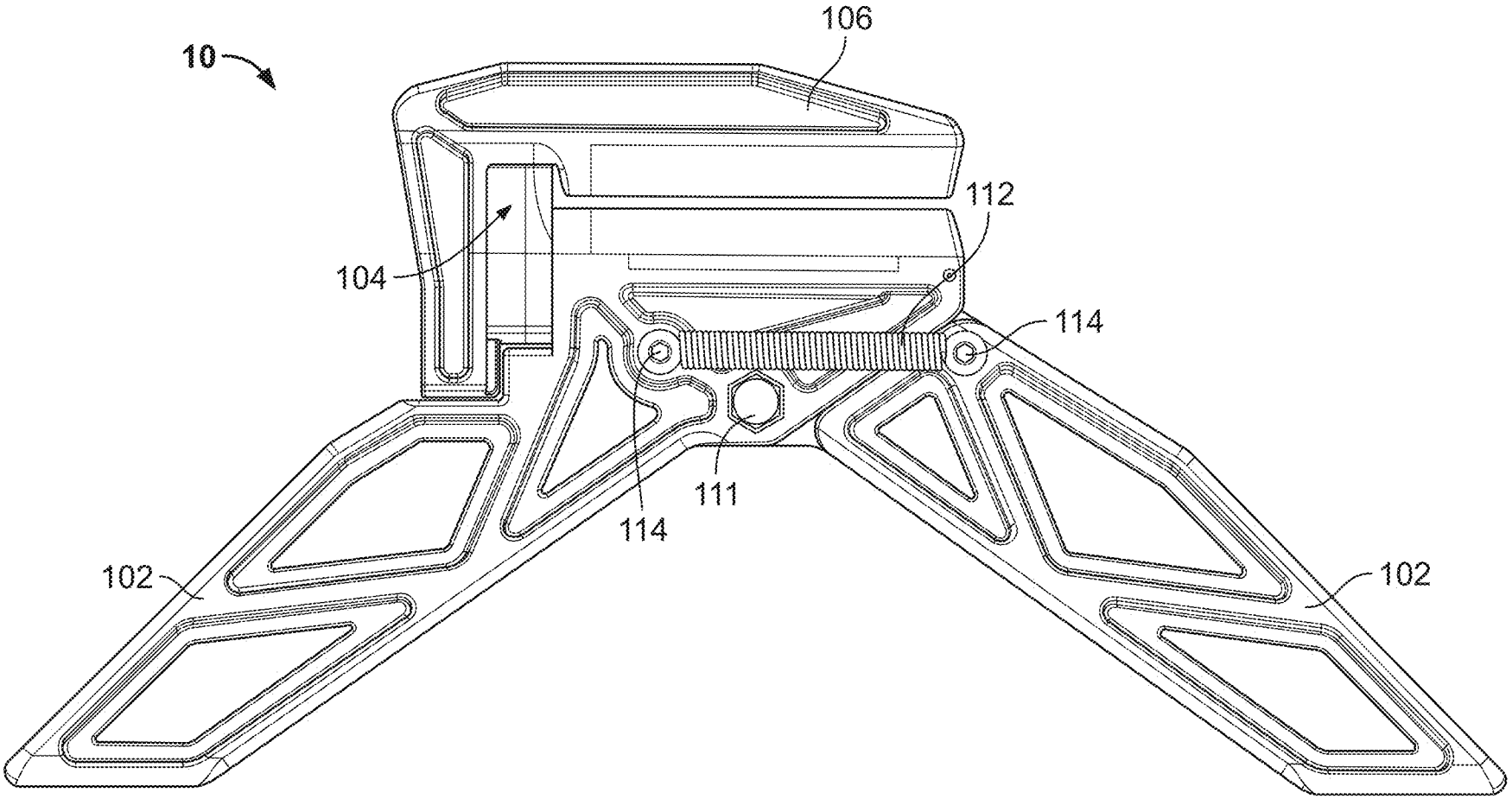
FIG. 3 depicts a rear view of an example archery bow pod as described herein.

As shown in FIG. 3, bow pod 10 may include hex nut 111 configured to engage button head hex drive screw 110 to secure legs 102 together. Spring 112 may be secured by hex drive screws 114 to legs 102. Spring 112 is configured to aid with the folding or collapsing of legs 102 into a stowed or travel position. Removing button head hex drive screw 110 from hex nut 111 may allow stowing or folding of the legs or dismantling of the legs.

Figure 4:
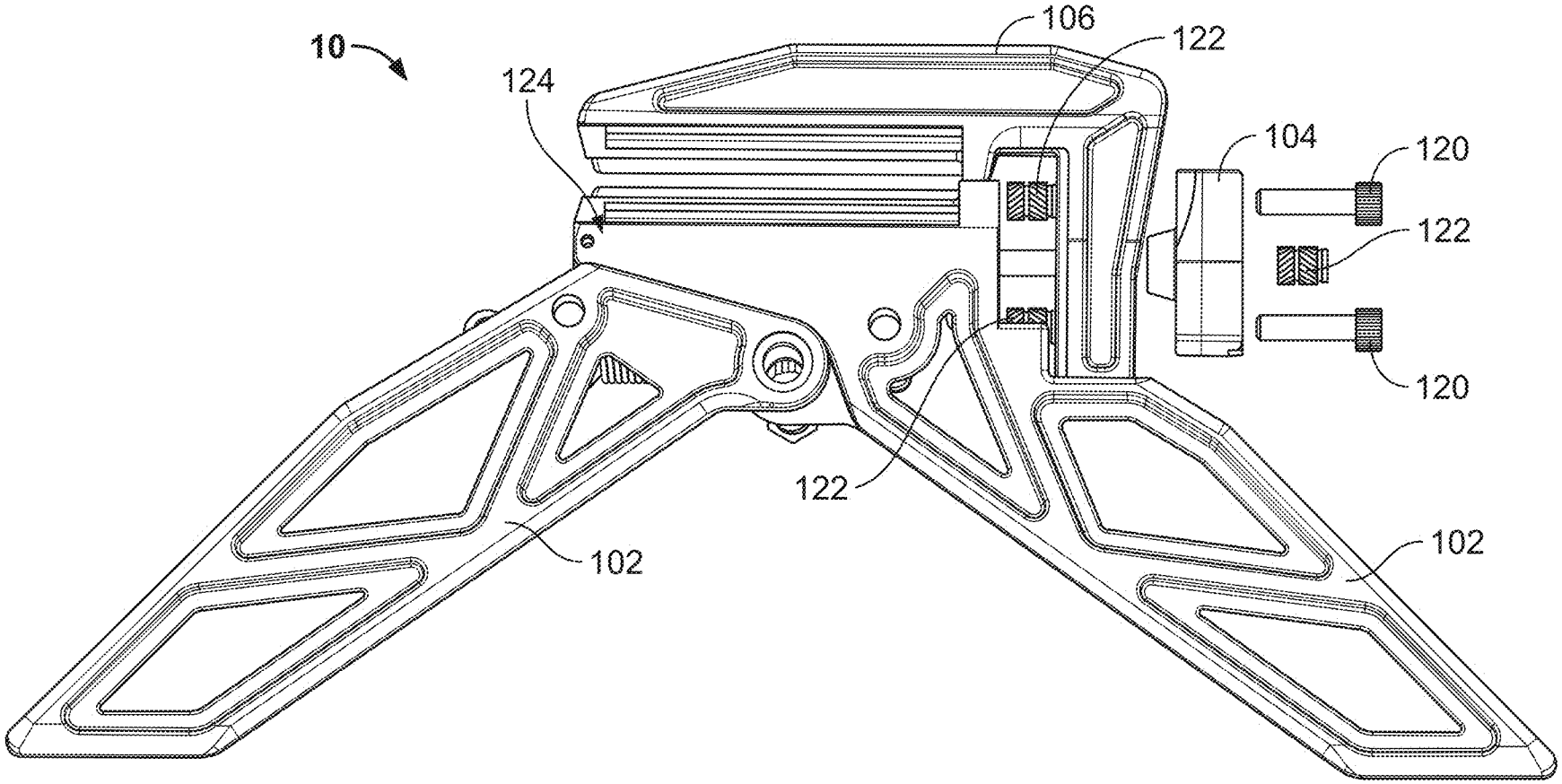
FIG. 4 depicts an exploded front view of an example archery bow pod as described herein.

As shown in FIG. 4, link 104 is depicted as removed from an engaged position with leg 102 and clamp 106. Axel screw 118 may be configured to removably secure clamp 106 to link 104 and leg 102. Clamp screws 120 may removably engage heat-set screws 122. Heat-set screws 122 may be set in clamp 106 and link 104. Axel screw 118 may engage heat-set screws 122. At least one leg 102 may include body 124 configured to engage one side of an archery bow riser opposite clamp 106.

Figure 5:
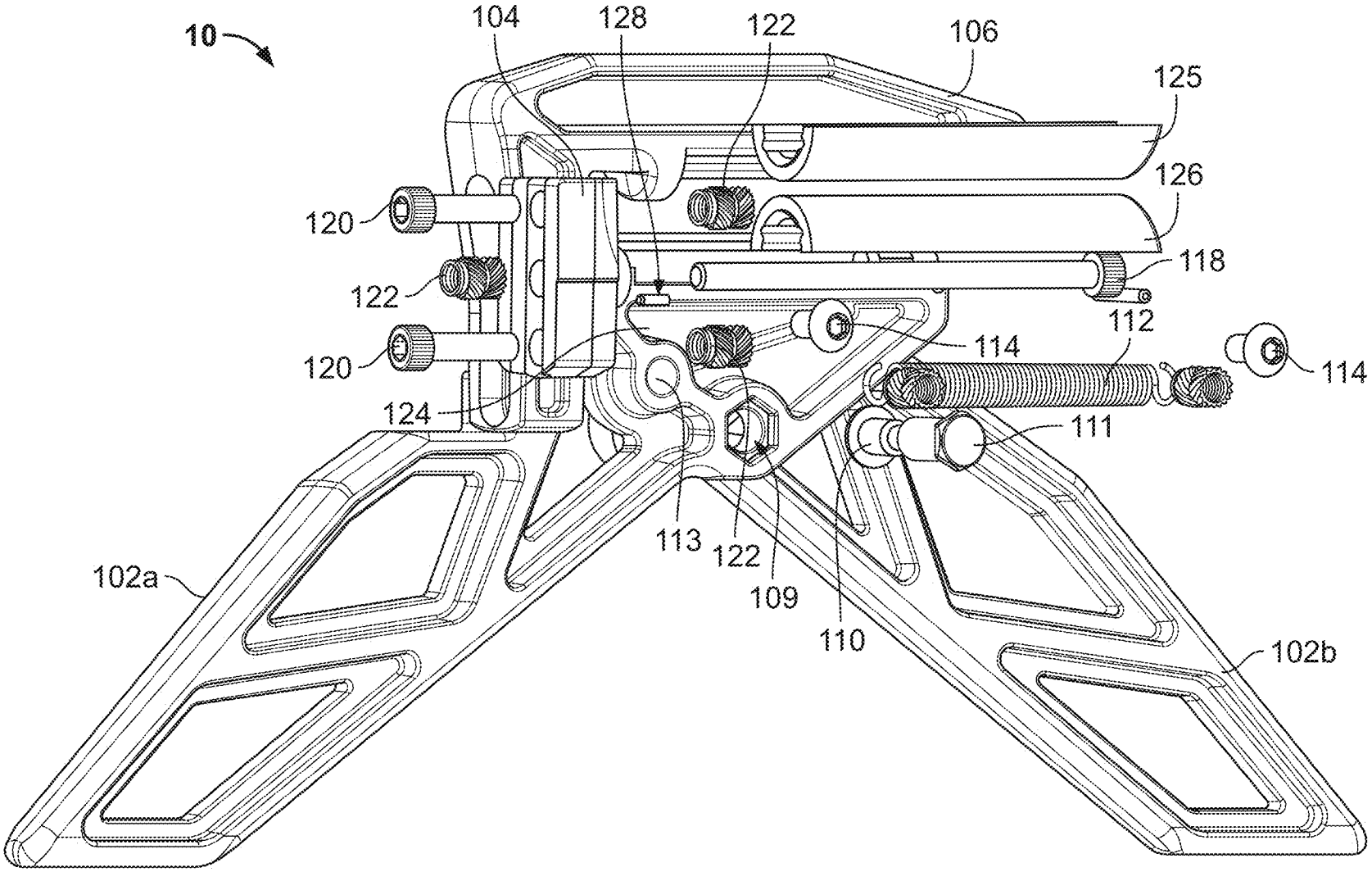
FIG. 5 depicts an exploded left-rear perspective view of an example archery bow pod as described herein.

FIG. 5 depicts an exploded left-rear perspective view of bow pod 10 and related components. Bow pod 10 may include legs 102*a* and 102*b*, axel screw 118, and clamp screws 120 configured to engage heat set screws 122. Body 124 may include hex nut port 109 configured to engage hex nut screw 111 which may be configured to engage button head hex drive screw 110 thereby securing leg 102*a* to leg 102*b*.

Figure 6:
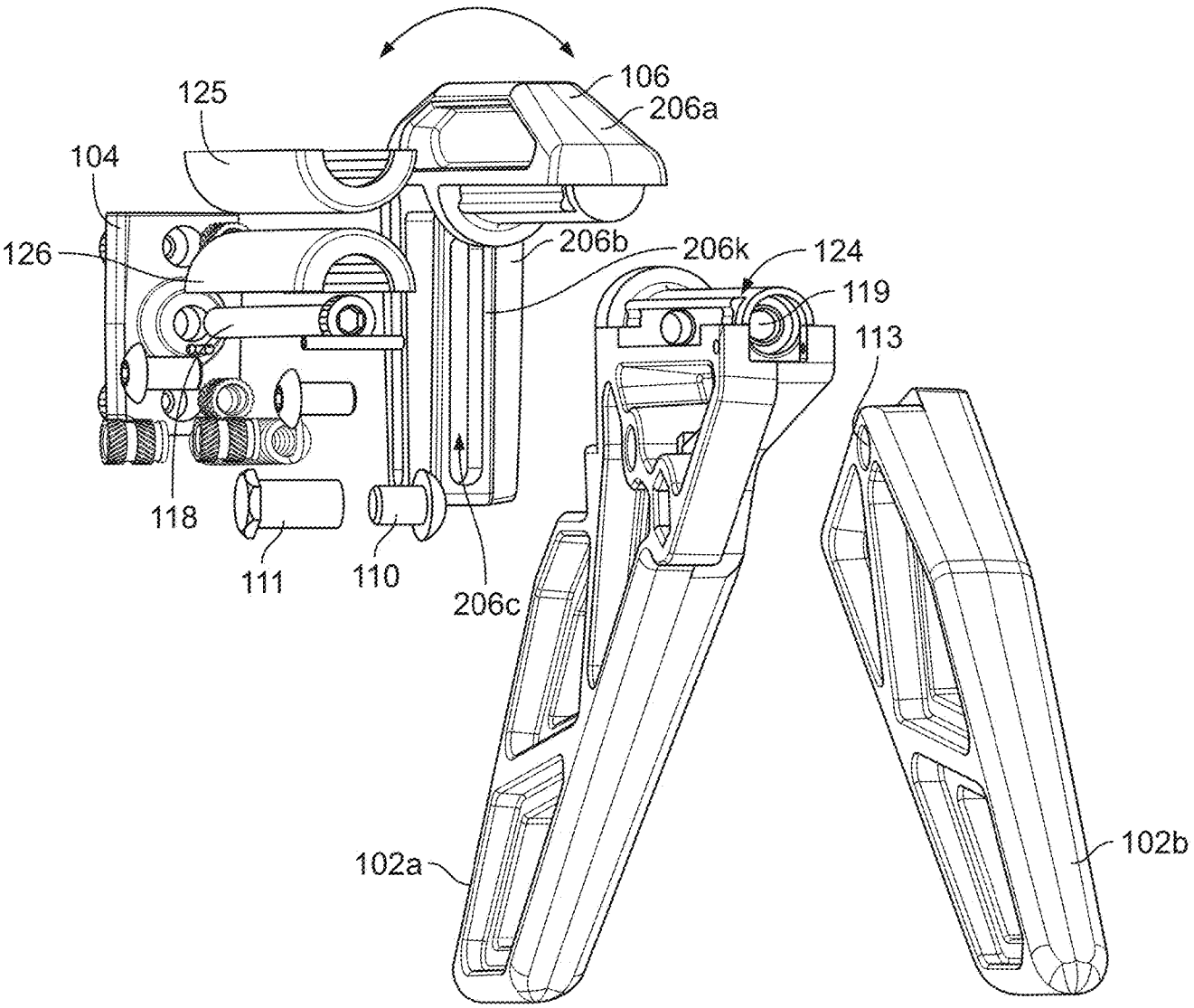
FIG. 6 depicts an exploded right-rear perspective view of an example archery bow pod as described herein.
Figure 7:
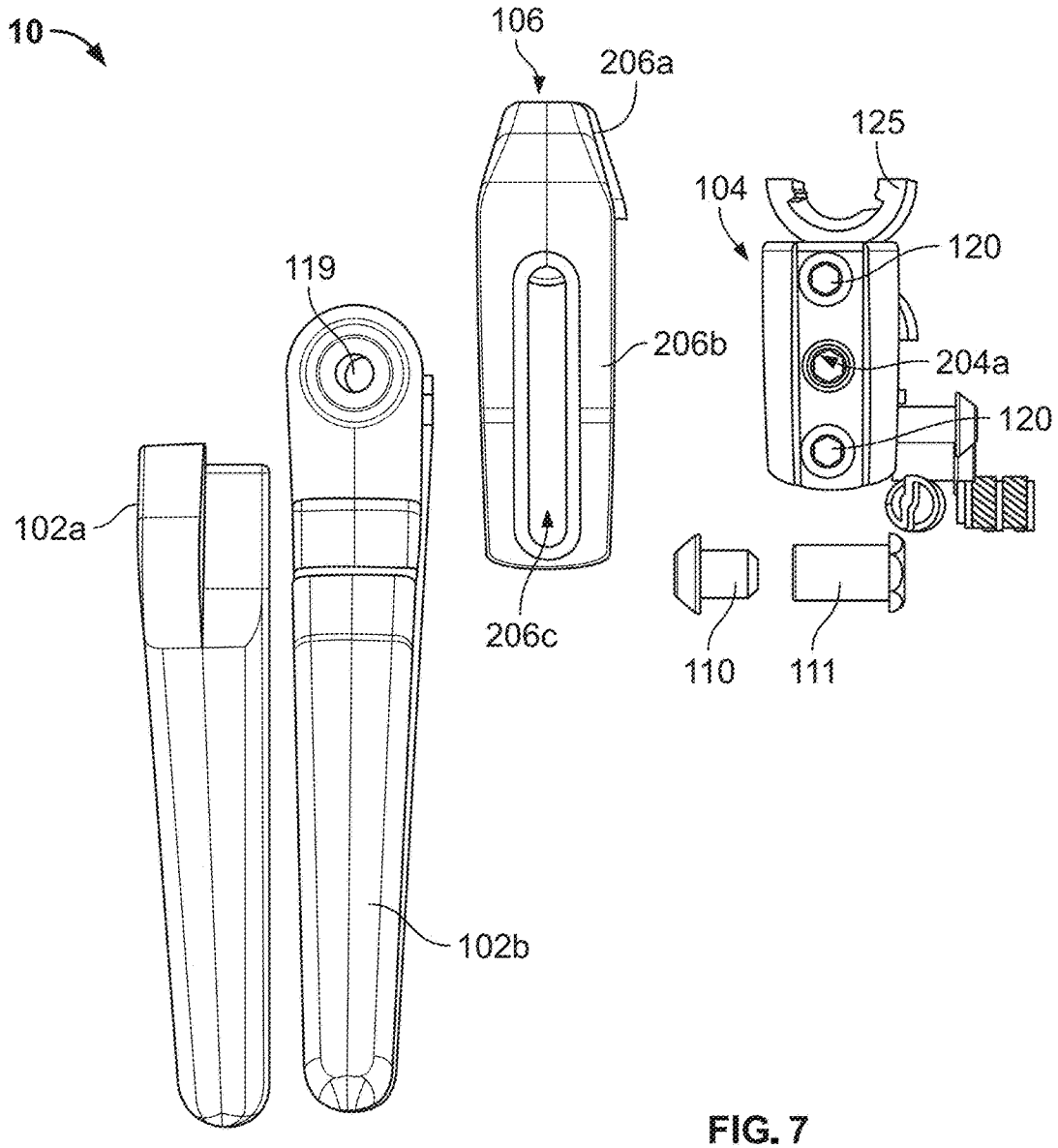
FIG. 7 depicts an exploded right-side view of an example archery bow pod as described herein.

As shown in FIGS. 6 and 7, body 124 may be positioned at an upper portion of leg 102*a* and may include port 113 configured to engage heat set screws 122 and hex drive screws 114. Leg 102*b* opposite leg 102*a* and body 124 may also include port 113 configured to engage heat set screws 122 and hex drive screws 114. Spring 112 may be secured by hex drive screws 114 to body 124 and port 113 of leg 102*a* and leg port 113 od 102*b*, as shown in FIG. 3. Press in dowel pin 128 may be configured to engage link 104. Press in dowel pin 128 may be further configured to function as a rotational stop for clamp 106. Clamp 106 may include upper bumper 125 configured to engage an archery bow riser (not shown). Lower bumper 126 may engage leg 102*a* body 124. Lower bumper 126 may engage the opposite side of an archery bow riser (not shown). Upper and lower bumpers 125 and 126 may include a rubber or polymer coating to provide a gripping surface to better facilitate attachment to an archery bow.

As discussed and depicted in FIGS. 6 and 7, leg 102*a* may include body 124 and may contain additional components not present in opposite leg 102*b*. Body 124 may include receptacle 119 configured to engage axel screw 118 which may be configured to removably secure clamp 106 to link 104 and leg 102*a*. Leg 102*b* opposite leg 102*a* and body 124 may also include port 113 configured to engage heat set screws 122 and hex drive screws 114. Clamp 106 may be generally "L" shaped and may include horizontal bar 206*a* and vertical post 206*b*. Horizontal bar 206*a* may be configured to engage upper bumper 125. Vertical post 206*b* may be configured to engage link 104. Compression cone 204*a* may be configured to mate with receptacle 119 of body 124. Vertical post 206*b* may further comprise clamp guide 206*c*. Vertical post 206*b* may include an interior lip 206*k* that generally follows the perimeter of clamp guide 206*c* (see FIG. 6). Clamp guide 206*c* may have an oval shape or a racetrack shape. Interior lip 206*k* may be configured to movably engage link 104. Clamp 106 may be adjusted in a vertical plane defined by clamp guide 206*c* and lip 206*k*. An archer may adjust the vertical position of clamp 106 to accommodate different shaped bows and different shaped bow risers. The vertical height of clamp 106 may also be positioned to secure an archery bow to be placed in an upright or vertical position when clamp 106 is secured and locked to link 104 via compression cone 204*a* and axel screw 118. Clamp 106 may be configured to rotate axially around body 124, leg 102*a* (as shown by the arrow in FIG. 6), and press in dowel pin 128 to allow the angular adjustment of the legs in relation to an archery bow limb angle to keep bow pod 10 perpendicular/vertical to a contact surface such as the ground. Press in dowel pin 128 may act as a rotational stop for the clamp 106 to prevent it from rotating past 45 degrees in either direction. In some examples, clamp 106 may rotate axially from about 0 degrees to about 90 degrees (horizontal) in either direction as limited by press in dowel pin 128. In other examples, clamp 106 may rotate axially in either direction from, for example, at least, greater than, less than, equal to, or any number in between about 0 degrees, 1 degree, 2 degrees, 3 degrees, 4 degrees, 5 degrees, 6 degrees, 7 degrees, 8 degrees, 9 degrees, 10 degrees, 11 degrees, 12 degrees, 13 degrees, 14 degrees, 15 degrees, 16 degrees, 17 degrees, 18 degrees, 19 degrees, 20 degrees, 21 degrees, 22 degrees, 23 degrees, 24 degrees, 25 degrees, 26 degrees, 27 degrees, 28 degrees, 29 degrees, 30 degrees, 31 degrees, 32 degrees, 33 degrees, 34 degrees, 35 degrees, 36 degrees, 37 degrees, 38 degrees, 39 degrees, 40 degrees, 41 degrees, 42 degrees, 43 degrees, 44 degrees, 45 degrees, 46 degrees, 47 degrees, 48 degrees, 49 degrees, 50 degrees, 51 degrees, 52 degrees, 53 degrees, 54 degrees, 55 degrees, 56 degrees, 57 degrees, 58 degrees, 59 degrees, and 60 degrees. A bow riser may also be released or unlocked from bow pod 10 via link 104 via clamp screws 120. Hex nut screw 111 and button head hex drive screw 110 may removably secure leg 102*a* to leg 102*b*.

Figure 8B:
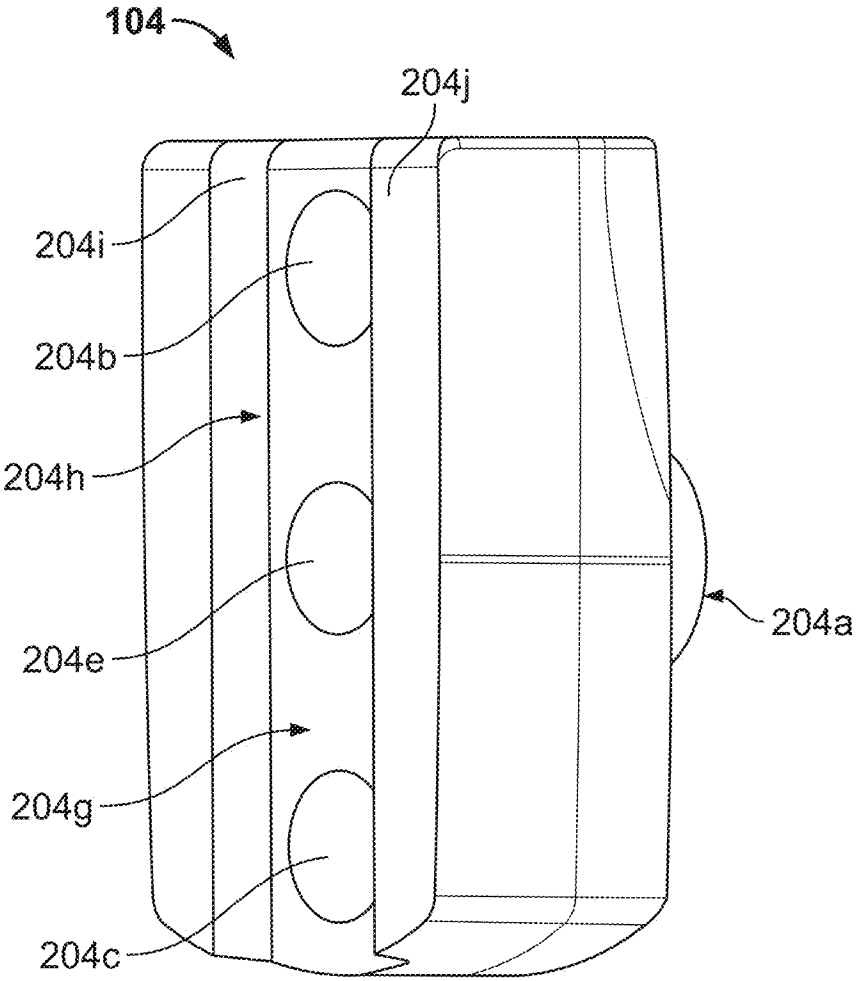
FIGS. 8A-8B depict an example bow pod link as described herein.
Figure 8A:
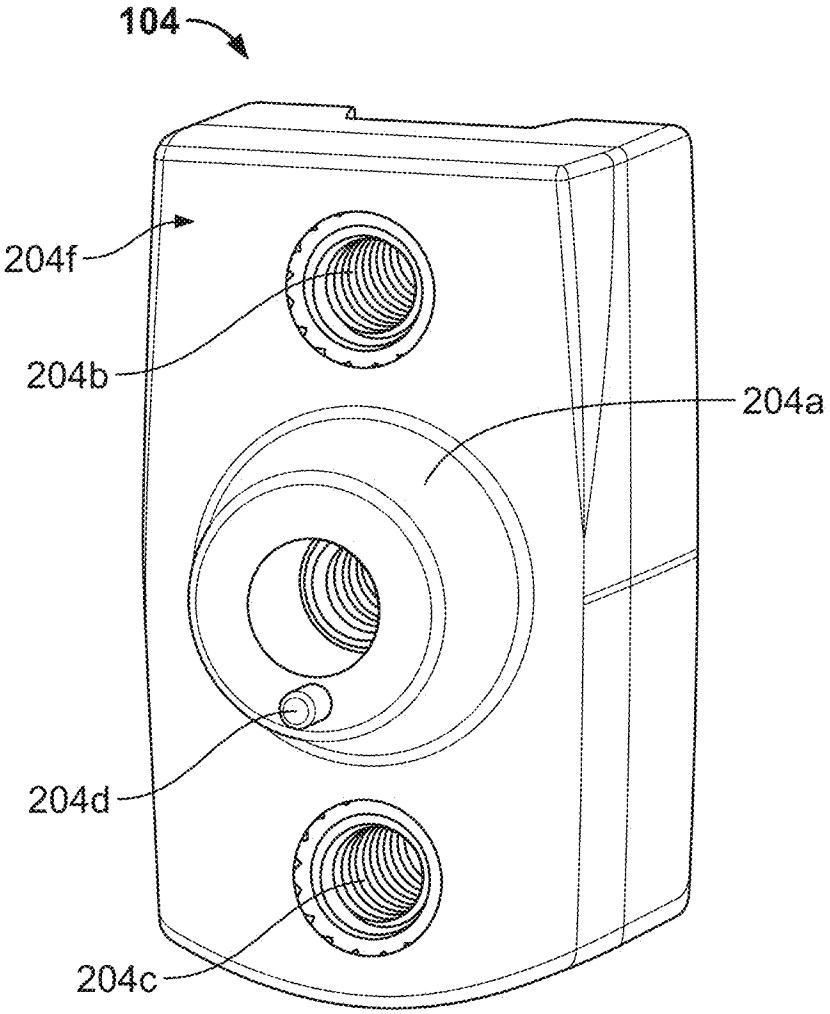

FIGS. 8A-8B illustrate link 104 as disclosed herein. Link 104 may be generally rectangular-shaped or cuboidal-shaped. Link 104 may include front face 204*f* and rear face

204*g*. Front face 204*f* may be formed with compression cone 204*a* positioned in the center of front face 204*f* and containing an orifice positioned in the center of compression cone 204*a* and extending from front face 204*f* to rear face 204*g*. Compression cone 204*a* may be generally cylindrical shaped and tapered, or frustoconical-shaped to assist with engaging link 104, and in particular, receptacle 119 shown in FIG. 6. Link 104 may include insert 204*b* configured positioned above compression cone 204*b*, and insert 204*c* positioned below compression cone 204*a*. Inserts 204*b* and 204*c* may be configured to removably engage clamp screws 120 and/or heat-set screws 122 to secure clamp 106 to link 104. Axel screw 118 may engage compression cone 204*b* and/or heat-set screws 122 to secure link 104 and clamp 106 to body 124 and leg 102*a* via receptacle 119. If clamp screws 120 are loosened, clamp 106 may be positioned in a lower or higher desired position in a vertical plane or axis (see FIG. 1). Clamp screws 120 may then be tightened to secure clamp 106 in the desired position in the vertical plane. Again, leg 102*a* may include body 124 and axel screw 118 may secure linker 104 to body 124 of leg 102*a*. Dowel pin 128 (also shown in FIG. 5) may removably engage a dowel pin guide positioned in a 6 o'clock position of FIG. 8A.

As shown in FIG. 8B, link 104 rear face 204*g* may include vertical groove 204*h*. First ridge 204*i* and second ridge 204*j* may be positioned on each side of vertical groove 204*h*. Ridges 204*i* and 204*j* may be parallel to each other. Clamp 106 lip 206*k* may be configured to engage rear face 204*g* via vertical groove 204*h*, first ridge 204*i*, and second ridge 204*j*. If clamp screws 120 unlocked or loosened, clamp 106 may adjust in a vertical plane guided by vertical groove 204*h*, ridges 204*i* and 204*j*, and clamp 106 lip 206*k*. A desired position may be set to an archer's preferences, or to better support a particular archery bow.

The archery bow pod system components disclosed herein may be constructed of various materials, such as one or more metals, alloys, polymers, ceramics, or fiber-reinforced materials, carbon-based materials, or similar materials well-known to those of skill in the art.

Specific elements of any of the foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

We claim:

1. An archery bow pod comprising:

a first leg;

a second leg configured to engage the first leg;

a link configured to engage the first leg, wherein the link comprises a front face and a rear face, and wherein the rear face comprises a vertical groove; and a clamp configured to rotate axially around a top of the first leg and configured to engage the link and an archery bow, wherein the archery bow is held in an upright position when engaged with the clamp.

2. The archery bow pod of claim 1, wherein the clamp is generally "L" shaped, and wherein the clamp is axially rotatable from about 0 degrees to +/−45 degrees.

3. The archery bow pod of claim 1, wherein the link is generally cuboidal shaped.

4. The archery bow pod of claim 1, wherein the vertical groove extends from a top of the link to a bottom of the link.

5. The archery bow pod of claim 4, wherein the link further comprises a first ridge and a second ridge positioned on each side of the groove.

6. The archery bow pod of claim 1, wherein the link comprises a compression cone positioned in a center of the link.

7. The archery bow pod of claim 6, wherein the compression cone is frustoconical-shaped, and wherein the compression cone extends distally from a front face of the link, and wherein the compression cone further comprises an orifice positioned in the center of the compression cone and extending through the front face of the link through a rear face of the link.

8. The archery bow pod of claim 7, wherein the compression cone is configured to engage the first leg, and wherein the clamp is movable in a vertical plane when the compression cone is engaged with the first leg.

9. An archery bow pod comprising:

a link comprising a front face, a rear face, a tapered compression cone extending distally from the front face, and a first insert positioned above the compression cone, and a second insert positioned below the compression cone;

a pair of legs configured to engage the link; and a clamp configured to movably engage the compression cone and an archery bow riser and rotate axially around an upper portion of the pair of legs, wherein an archery bow is maintained in a vertical position when the clamp is secured to the archery bow riser and the pair of legs are positioned on a surface.

10. The archery bow pod of claim 9, wherein the pair of legs are configured to engage a tension spring, and wherein the tension spring maintains the pair of legs in an extended position.

11. The archery bow pod of claim 9, wherein the pair of legs are foldable.

12. The archery bow pod of claim 9, wherein the pair of legs comprise trestle structures.

13. The archery bow pod of claim 12, wherein the trestle structures are diamond-shaped, triangular-shaped, or polygonal-shaped.

14. The archery bow pod claim 9, wherein the clamp is generally "L" shaped.

15. The archery bow pod of claim 14, wherein the clamp comprises a vertical post and a horizontal bar, wherein the vertical post is configured to engage the link, and wherein the horizontal bar is configured to engage the archery bow riser.

16. The archery bow pod of claim 15, wherein the vertical post comprises a clamp guide configured to engage the compression cone, and wherein the clamp is movable in a vertical plane when the compression cone is engaged with the clamp guide.

17. The archery bow pod of claim 15, wherein the horizontal bar comprises a polymer or rubber coating.

18. The archery bow pod of claim 9, wherein the archery bow is a compound, a recurve, or a longbow.

19. A system comprising:

an archery bow; and a bow pod configured to engage the archery bow, the bow pod comprising:

a first leg;

a second leg;

a clamp; and a link, wherein the link comprises a front face and a rear face, and wherein the rear face comprises a vertical groove, wherein the first leg is configured to engage the second leg, wherein the first leg is configured to engage the link, wherein the link is configured to engage the clamp, wherein the clamp is configured to rotate axially around the first leg and the second leg, wherein the clamp is configured to removably engage a riser of the archery bow, and wherein the archery bow is held in an upright position when engaged with the clamp.

* * * * *